United States Patent [19]

Zingher et al.

[11] Patent Number: 5,014,618

[45] Date of Patent: May 14, 1991

[54] SENSOR BASED INKING CONTROL FOR A PRINTING PRESS

[75] Inventors: Oded Zingher, Alzenau; Arno Wuhrl, Muhlheim am Main; Ullrich Behrendt, Dreieich; Ralf Schafer, Florsheim Wicker; Günter Ziesing, Rodgau, all of Fed. Rep. of Germany

[73] Assignee: MAN Roland Druckmaschinen AG, Fed. Rep. of Germany

[21] Appl. No.: 400,569

[22] Filed: Aug. 30, 1989

[30] Foreign Application Priority Data

Aug. 30, 1988 [DE] Fed. Rep. of Germany ..... 3829341

[51] Int. Cl.[5] ..... B41F 31/00; B41F 33/00

[52] U.S. Cl. ..... 101/365; 101/484; 101/DIG. 47

[58] Field of Search ..... 101/DIG. 47, DIG. 45, 101/365, 484; 364/519

[56] References Cited

U.S. PATENT DOCUMENTS 3,958,509 5/1976 Murray et al. ..... 101/DIG. 47
4,639,776 1/1987 Foerster et al. ..... 101/365 X

FOREIGN PATENT DOCUMENTS 2095178 9/1982 United Kingdom ..... 101/DIG. 47

*Primary Examiner*—Clifford D. Crowder
*Attorney, Agent, or Firm*—Leydig, Voit & Mayer

[57] ABSTRACT

A system and associated method for low cost image scanning and automatic ink adjustment control in a printing press. The system dispenses with automatically positioned densitometers and the system feedback which associates densitometer position with ink adjusters in the press. Instead, at the outset, image zones in a printed form are associated with ink zones on the press, as determined by the particular form being printed. The operator is then led to take manual densitometer readings of each image zone, and the system determines whether the reading is proper, whether it is within standards, and if the operator should advance to a reading of the next zone, so directs the operator.

12 Claims, 2 Drawing Sheets

SENSOR BASED INKING CONTROL FOR A PRINTING PRESS

FIELD OF THE INVENTION

This invention relates to printing presses and more particularly to systems and methods for ink control in rotary printing presses.

BACKGROUND OF THE INVENTION

Rotary printing presses conventionally include ink fountains with zone width adjustments across the fountain for controlling ink feed in strip-like regions positioned side-by-side across the printed form. The adjusters can take various mechanical forms, but as a common feature, they typically control the ink film thickness in respective zonal widths across the fountain, and the ink film thickness as applied to the form controls the printed optical density of the form. In multicolor printing work, it is typical to individually control the film thicknesses of the individual colors which are superimposed, and the quality of the final printed result is determined by the control exercised over the film thicknesses of the individual ink films.

Printing plants capable of producing the highest quality product have evolved toward a high standard of automation wherein image scanners are utilized to scan the printed image and have automatic control systems coupled to the scanner for directly controlling ink adjustment on the press. Without describing all of the complex interrelationships necessary for successful operation of such a high quality feedback system, it will be appreciated that at a minimum there is required a scanner (such as a densitometer) which is automatically positioned by the control system with respect to the form to provide position feedback for the scanner to the control system. In order for the control system to accomplish its function of adjusting the appropriate ink keys to produce the desired printed density on the printed form, the control system must know the zone being scanned by the scanner at the time the reading is made. As a result, such automatic control systems often utilize relatively complex scanning mechanisms with scanning heads which are automatically positioned by motor controlled closed loop control systems to read the image while at the same time indicating position of the scanner head with respect to the printed form. As an alternative, scanning elements are sometimes positioned across the press in fixed locations, and their signal is known to relate to ink film thickness produced by one or more ink feed mechanisms located in a known positional relationship with respect to the scanner.

Many fully automated scanning and adjustment systems have also evolved to require an ink check strip printed along one of the borders of the printed form. The scanner scans the check strip rather than the image in order to eliminate as many variables as possible which might result from scanning the image. The check strip usually includes both solids and screens of the individual colors which have produced the overall printed image, and scanning of those individual patches in the check strip provides data which is processed to determine the nature of the ink adjustment to be applied to each zone of the press.

Such automatic control systems can be relatively expensive and can require relatively sophisticated operators to exercise the necessary care and skill in seeing to the appropriate adjustments. As a result, much printing today is still produced in printing plants where quality control on the press relies largely on the subjective judgment of the pressman viewing samples of the printed form. Occasionally, an off-line densitometer is available to quantify the subjective judgment at particular key points in the image, but in the end it is the subjective judgment of the operator, sometimes aided by densitometric quantitative data, which results in the operator selecting one or more ink keys for adjustment to alter the image quality of the printed form.

SUMMARY OF THE INVENTION

In view of the foregoing, it is a general aim of the present invention to provide a simplified low cost scanning system for assisting a pressman in automatically adjusting ink feed (with respect to image zones) in a printing press, but without the cost and complexity of a fully automated scanning system.

In accomplishing that aim, it is an object to provide an ink adjustment system based on a manually positionable densitometer or spectrophotometer utilized in conjunction with a system which is set up to associate image zones on the form being printed with ink zones in the press so that an operator need scan only the image zones while the system then identifies and adjusts the particular ink zones which require adjustment.

In that respect, it is an object to provide such a system with an image zone memory which correlates image zones on the particular form being printed with ink zones in the press which is to print the form so as to ease the operator's burden in adjusting the press to achieve a particular result.

It is a feature of the present invention that the system provides an image zone memory which relates image zones on the printed form with ink zones on the press which will print the particular image zones. A manually positioned densitometer is then positioned by the operator in a desired image zone, and an image quality reading taken, then automatically compared to a standard for that image zone. If the reading indicates the printed image is out of standard, the system automatically determines the particular ink adjusters to be manipulated, then automatically causes the manipulation to adjust the printed image in the desired image zone.

As a further feature of the invention, display means is associated with the image scanner and indicates to the operator whether the system is ready to take an additional image zone reading, and identifies to the operator the particular image zone next to be read.

In sum, the subjective judgment normally exercised by an operator functioning without an automatic control is largely eliminated but without the expense and complication normally associated with a fully automatic closed loop control.

It is a feature of the invention in certain of its embodiments that ink check strips can be dispensed with when desired, and the operator can scan the image portions of the form to acquire the needed image data.

In accordance with the invention, there is provided a system for controlling the ink adjusters in a printing press. The system includes a localized image scanner which is manually positionable with respect to the printed form for obtaining measurements of image quality at selected positions on the printed form. The system includes processor means which accepts and evaluates the scanner measurements. Means are associated with the processor for segregating the image in the printed form into a plurality of discrete image zones for individualized control. An ink zone memory cooperates with the processor for relating image zones on the printed form to inking zones on the printing press. The processor utilizes operator interface means for directing an operator to scan a particular image zone (by indicating that the scanner is ready and the identity of the zone to be scanned). Output means associated with the processor reads the image zone memory for out-of-specification image zones to determine the ink keys which are printing those out-of-specification zones, and makes the appropriate ink adjustment.

Other objects and advantages will become apparent from the following detailed description when taken in conjunction with the drawings, in which:

While the invention will be described in connection with a preferred embodiment, there is no intent to limit it to that embodiment. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1:
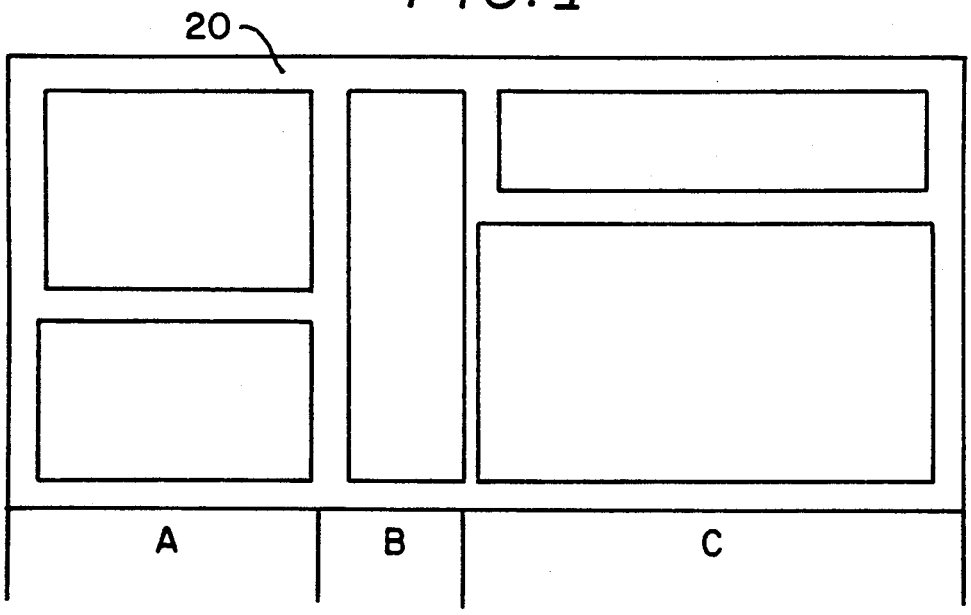
FIG. 1 is a diagram illustrating a printed form divided into a plurality of image zones.

Turning now to the drawings, FIG. 1 shows a diagram of a printed sheet 20 representing the form to be printed on a rotary printing press. It will be appreciated that the pattern of the form is arbitrary, and the composition of the particular form will determine the manner in which image zones are assigned for any particular printing form. In the FIG. 1 embodiment, different types of print are disposed in different areas of the sheet, some of the areas containing text, some photographs, some line drawings, and the like. It will be appreciated by those skilled in the art that these different forms of individual makeup require different quantities of ink to print to standard, and the ink adjusters across the printing press are adapted for differential adjustment from adjuster to adjuster so as to provide the necessary control. The ink adjustment across the press is often considered to be in column form, with the columns being disposed in side-by-side relationship across the press, the width of the columns being determined by the length across the fountain of the particular ink adjuster.

Considering the form shown in FIG. 1, it will be seen that such a form can be divided into a plurality of image zones of unequal width, and the illustrated embodiment comprising image zones A, B and C. The image zones as will be apparent are in strip-wise increments defined along the form in the same direction as the ink control zones across the press, such that a definite relationship can be established between image zones on the form and ink control zones on the press. In the extreme case, a form or sheet can be subdivided into 8 or 16 equally wide areas and each of such areas may contain 4 or 8 ink adjusters for controlling the density of the image in the respective ink control zones. As noted above, in the form illustrated in FIG. 1, the references A, B and C have been assigned to the respective control zones. While the ink control zones are not overlayed in FIG. 1, on a typical press the smallest zone, that labeled B, would include on the order of six to eight ink control zones on the press. The difficulty of manually controlling ink adjusters for an image zone having a relatively large number of adjusters will be apparent when it is appreciated that typically a printing press is set up with individual switches for each of the ink adjusters. Thus, if an image zone has more adjusters (and therefore more control switches), than a pressman has fingers, it requires a multiple step operation on the part of the printer to make the necessary adjustment across the image zone. In short, manual adjustment leaves much to be desired in dealing with relatively large image zones as illustrated by zone C of FIG. 1. If, on the contrary, the form of FIG. 1 were printed on a completely automated press having a closed loop system, the form 20 would be positioned on a table associated with an automatically positioned densitometer which would scan the sheet from one edge to the other, recording density measurements in each ink zone across the form. That information would be utilized to adjust each of the individual ink keys for the density in that ink zone width.

In accordance with the invention, however, the sheet is segregated into multiple ink control zone widths comprising a plurality of image zones, and each of the image zones is manually scanned by means of a manually positionable image scanner to record data which is then automatically utilized by the control system. The control system associates relatively wide (multiple adjuster) image zones as shown in FIG. 1 with the ink control zones on the press such that if an adjustment is necessary, the particular ink zones which control an image zone are determined then automatically adjusted in order to achieve the desired printed result.

Figure 2:
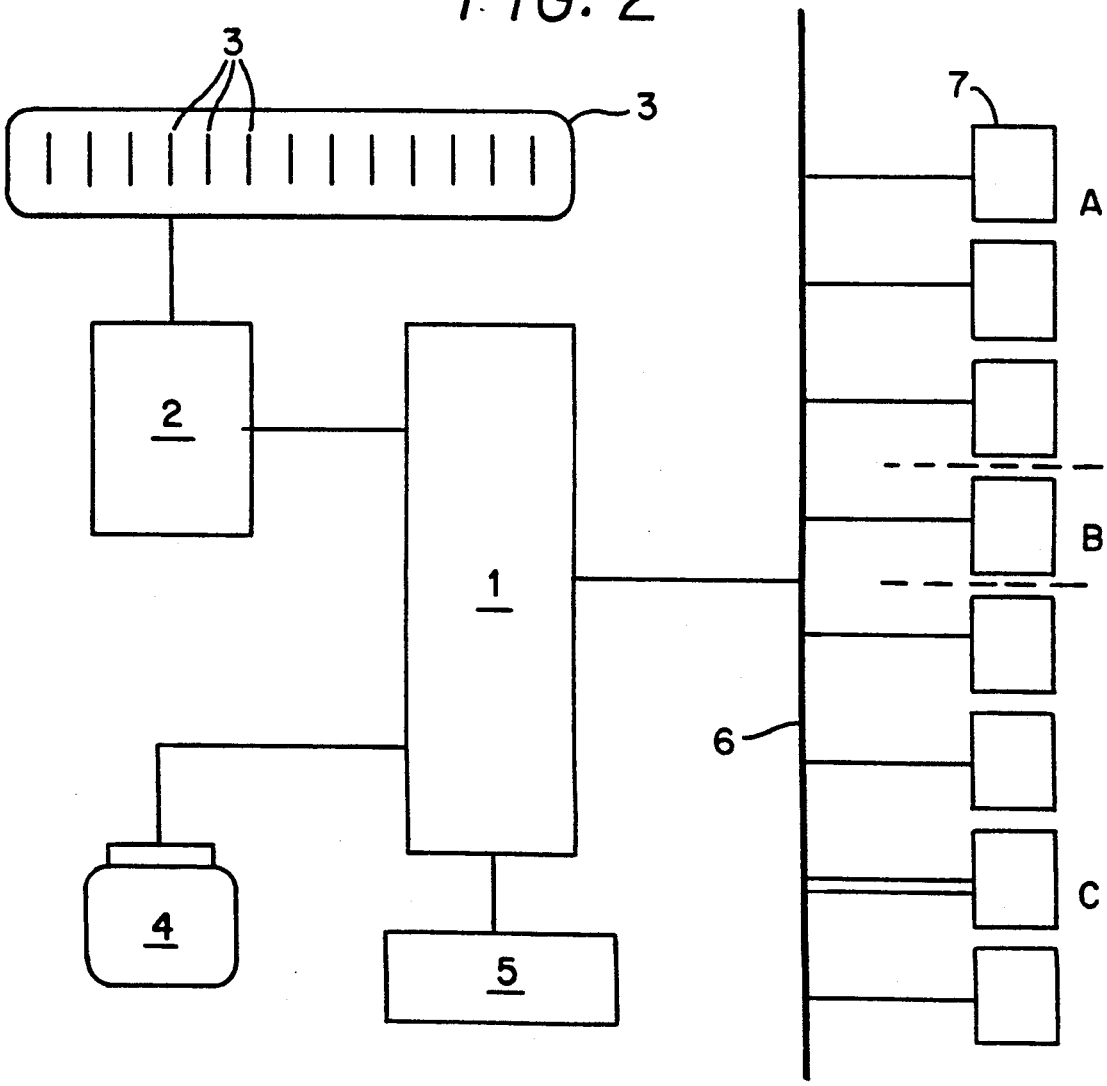
FIG. 2 is a block diagram illustrating a system for image scanning and ink control exemplifying the present invention.

Referring more particularly to FIG. 2, there is shown a system exemplifying the present invention. The system includes a central processor or computer 1 which performs the logical functions associated with the system. The processor includes the standard forms of memory for controlling its operation including a program ROM (not separately illustrated) and working memory including memory sections 2 and 5. The memory section 2 comprises an image zone memory for storing information which correlates image zones on the form (FIG. 1) with ink control zones in the printing press. The memory section 5 comprises an image data memory which stores ink density information for each image zone. Such density information can include both previously recorded density information which is within standards, as well as the standards themselves which are input at the start of the run either by scanning the check proof or by actually keying in the desired density for each of the image zones.

FIG. 2 illustrates an ink fountain and its adjusters 7 and the relationship between the ink adjusters 7 and the image zones A–C. Only 8 ink adjusters are illustrated in FIG. 2, whereas the typical press includes perhaps four times that number, but the drawing is illustrative of the principles involved. It is seen that a relatively small number of adjusters (only one in the illustrated diagram) are used for controlling image zone B whereas four adjusters are used for controlling image zone C. While FIG. 2 is simplified in its correlation between ink control zones and image zones, it illustrates the principle that one can mentally correlate with the other, so that the ink control zones produce the ink film which is applied to the web to produce the image zones.

In practicing the invention, means are provided for correlating image zones on the form (FIG. 1) with the ink control zones established by the mechanical adjusters 7. In the FIG. 2 embodiment, such means are illustrated as input means 3 which has a plurality of separating of divisional lines 3*a* which define the ink control zones in the press. A form such as the FIG. 1 form is placed on a control panel juxtaposed with the divisions 3*a* of the input means 3 and when the form is properly registered, the correspondence between the ink control zones and the image zones will be readily established. Having thus appropriately registered the form, the operator will then input information via the processor 1 into image zone memory 2 which correlates the image zones and ink control zones. For example, switches interposed between the dividing lines 3*a* in the control panel 3 can be used to register the edges of the ink control zone or alternatively all of the switches within a particular zone can be depressed followed by depression of an enter key to define an image zone. As an alternative, it is simply necessary using a personal computer apparatus to input either by means of a keyboard or by appropriate graphics on the screen using a mouse-type input device the corresponding relationship between image zones on a press with displayed ink control zones on the screen.

In any event, and in accordance with an important aspect of the invention, the image zone memory 2 correlates image zones on the form to be printed with ink control zones in the press. It will be appreciated that the latter remains constant for any given press at all times, whereas the former changes from job to job, as the nature of the printed form changes. However, at the start of the run, once the operator has utilized the input device 3 to input the correlation, that information continues to reside in image zone memory 2 and is available for the system in making any ink corrections which are found to be necessary.

In further practice of the invention, the system of FIG. 2 includes a manually positioned scanning apparatus 4 which is adapted to take measurements of the image when positioned on the form of FIG. 1, and to input such measurement information to the processor 1. The scanning device 4 is preferably a densitometer (operating with color filters in the case of multicolor printing) or is alternatively a spectrophotometer. In any event, the scanner 4 is manually positionable in any location on the form of FIG. 1 and preferably includes a "read" key for signalling the processor 1 that the scanner is in position and a reading is to be taken. The scanner can be positioned in desired locations in the respective image zones A, B, C as determined by the operator. Alternatively, a check strip can be printed in one of the elongate borders of the form and the image scanner 4 positioned along the check strip for taking readings in the respective image zones A, B or C.

FIG. 2 also shows a link 6 between the computer 1 and the respective ink adjusters 7 in the ink fountain. The connection 6 is typically a multiconductor data bus which allows the computer 1 to drive each of the adjusters 7 independently of the others to make whatever ink adjustments are found to be necessary to the printed form. The computer 1, thus having determined that adjustment of one or more ink adjusters is necessary, simply outputs signals on the bus 6 to the particular adjusters for a time adequate to make the necessary correction.

In practicing the invention, the computer 1 has reference to the information stored in image zone memory 2 in selecting particular ink adjusters 7 for manipulation. Thus, if it is determined that the image zone C requires adjustment, the computer 1, having read the concordance in table 2 between image zone C and the ink adjusters which control it, will thereupon couple signals to only those ink adjusters (at the lower portion of FIG. 2) which control the density of the image zone C in the form being printed. Thus, the computer 1 acting in concert with the image zone memory 2 is capable of selecting the particular ink adjusters based on only a single measurement in the image zone as accomplished independently by the operator, under prompting of the system soon to be described.

Completing the system of FIG. 2 there is shown an image data memory 5. The image data memory 5 is associated primarily with the data logging scanner 4 and is adapted to store image data measured by the scanner. The memory 5 is preferably divided for a particular job into a plurality of sections corresponding to the respective image zones. Thus, image zone data measured by the scanner 4 is stored in respective locations in the image data memory 5. In addition, the image data memory 5 preferably includes locations for storing standards for each of the image zones A–C. The standards can be determined in an initial operation either by scanning of a proof or keying in standard data for that particular run. In any event, the standards as well as prior information stored in the image data memory 5 are available to the processor 1 for comparison with new readings made by scanner 4 to determine if a particular image zone is being printed within or outside of allowable tolerances.

Figure 3:
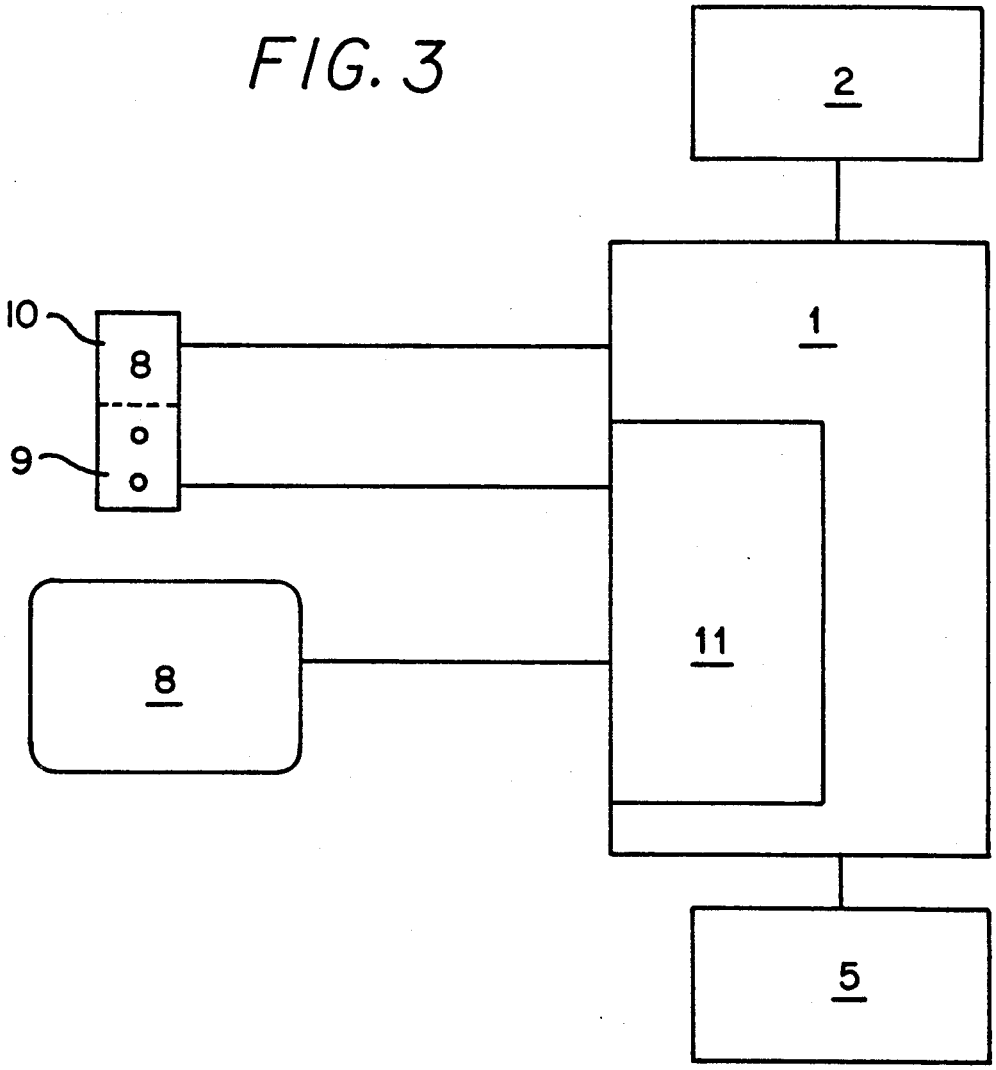
FIG. 3 is a diagram further illustrating the sensing and checking elements of the system of FIG. 2.

Turning now to FIG. 3, there is shown additional detail of the interrelationship between the processor 1, its associated memories 2, 5, the data logging means 4 (in the FIG. 3 embodiment illustrated as densitometer 8) and an associated operator interface means comprising indicator 9 and numeric (or alpha numeric display 10). The processor 1 is shown as including evaluating means 11 connected to the densitometer 8 for accepting image data information therefrom and comparing it with standard or previously acquired data in memory 5 for determining if the scanned data is acceptable or whether an ink adjustment should be made. The status display 9 is also connected to evaluator means 11 for determining the busy or ready status of the scanner. The status display 9 preferably includes one or more LED's, in a preferred embodiment two LED's comprising a green ready LED or a red busy LED. The LED's can be used to signal three conditions—one in which the unit is busy and new readings should not be taken, one in which a new reading should be taken, and a flashing indication in which a particular reading should be repeated. To aid the operator in determining which image zone should be scanned, the operator interface means further includes a display 10 for displaying to the operator an identifier of the image zone which is next to be scanned. Thus, an operator need only observe the LED's in the display region 9 to determine when the unit is ready, observe the indicator in display region 10 to determine which zone should be scanned, then position the densitometer to take a reading. The process thereupon acquires the data from densitometer 8 into evaluator means 11 and compares the acquired data with previously acquired or standard readings. If the reading is determined to be within standards, the data is simply stored in memory 5 in a location associated with the image zone which had been scanned. If the data is not within standards, the processor 1 then interrogates the image zone memory 2 to determine the identity of the ink keys which are controlling the density of the image zone which has been scanned, then operates via bus 6 (FIG. 2) to adjust the particular ink adjusters in an appropriate direction and for a length of time necessary to bring the printed image into the desired standards.

Figure 4:
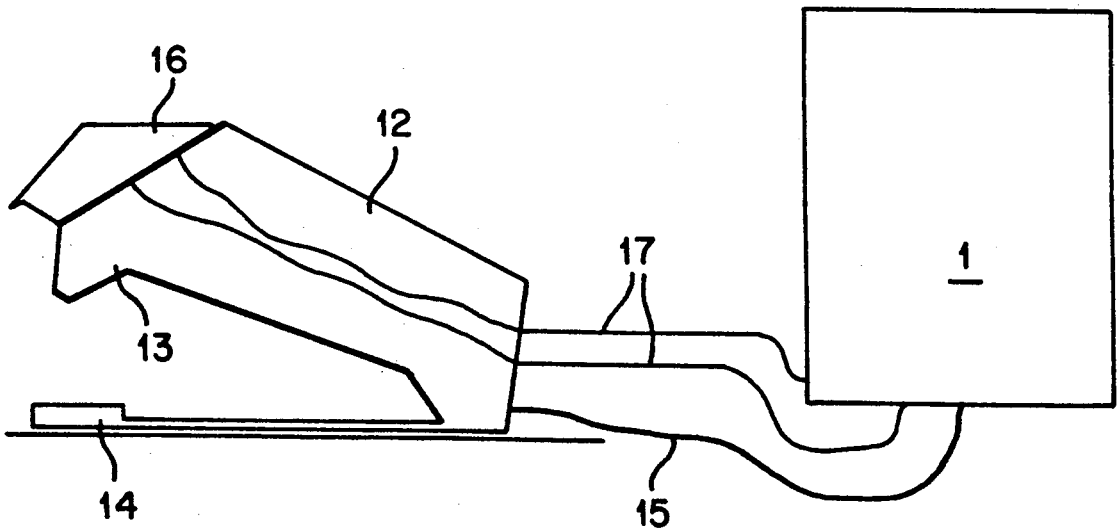
FIG. 4 illustrates further details of a densitometric sensing device and controlling processor for the system of FIG. 2.

Turning now to FIG. 4, there is shown a manual densitometer 12 suitable for serving as the data logging instrument 4 of FIG. 2. The densitometer 12 comprises a pivotable measuring head 13 attached to a base having position fixing means 14. The position fixing means 14 enables the densitometer to be positioned for free movement at any position on the printed form (FIG. 1). The densitometer 12 is connected to the computer 1 by means of a data line 15. An optical display 16 is provided and is preferably attached to the densitometer 12, i.e., as by affixing it to the measuring head 13. The optical display 16 is preferably affixed by conventional expendients such as clips or the like such that the display 16 which is an element of the system of FIG. 2 can be affixed to and utilized with density measuring heads of various configurations. Thus, the system of FIG. 2 need not be restricted to densitometers of a particular configuration, but in keeping with the invention is widely applicable to numerous types of instrumentation.

In the place of the densitometer 8 of FIG. 3, a spectrophotometer can be used as is well known in the printing art. Use of the spectrophotometer insofar as the operator is concerned will be substantially the same as use of the densitometer. However, the evaluation algorithms in the computer 1 will require alteration in switching from the densitometer to the spectrophotometer.

The visual display 16 which is attached to the scanning head is electrically connected to the computer 1 as illustrated in FIG. 3, the optical display 16 carrying the LED status indicators 9 and the image zone indicator 10. In the standby condition, the densitometer head 13 extends upwardly in the manner illustrated in FIG. 4 and the display means 9, 10 is readily visible to the operator on the optical display 16. The computer 1 controls the LED's 9 in the display 16, as well as the digital display 10, such that the pressman receives direct information about the control actions which he is to perform. When the density measuring head 13 is pivoted downwardly to its measuring position, a reading is automatically triggered by means not shown, and the computer 1 controls the illuminated condition of the status display 9 to illuminate a red indicator showing that the densitometer is momentarily engaged in a measurement. A second of the status LED's is not illuminated at that time. After the densitometer image data has been transferred by means of data link 15 to the processor 1, and the processor 1 has tested the data to assure its integrity, the LED display is then illuminated by the processor 1 to either flash the red indicator or to illuminate the green indicator. A flashing red display indicates a defective measurement or incomplete data transmission while a green signal means that the measurement was satisfactory and the process can proceed to the next image zone. The digital display at that time is also refreshed to indicate the identity of the next zone to be scanned, so that the operator is appraised not only that the previous reading has been made, that it is acceptable, that the unit is ready for the next measurement, and the identity of the next zone to be scanned. The complete guidance of the operator by means of the system thus far described will be apparent. The system thus assures that appropriate data is taken for assuring proper ink adjustments, but without the expense and complication normally associated with a closed loop scanning device. While the system is less foolproof than an automatic scanning device, assuming a reasonably competent operator and the prompting and aid provided by the system, it will be appreciated that high quality printing is readily available utilizing a system as illustrated in FIGS. 1–4.

It will be apparent that the invention has certain method aspects which go hand-in-hand with the system aspects in the practice of the simplified ink control scheme. To summarize, during setup, an operator examines the printed form to define the independent image zones on the printed form. The operator then utilizes input means 3 (in any of the various forms described above) to associate image zones on the form with ink control zones on the press. Such correlated information is stored on image zone memory 2 by the operation of central processor 1. Having thus stored the setup information, and after the press run has commenced, the operator is in a position to scan the previously defined image zones to check printing quality and automatically adjust the fountain when needed. The system guides the operator in performing those functions. Thus, the operator utilizes a scanner 4 such as a densitometer or a spectrophotometer, and observes the electronic display 16 including status display 9 and zone display 10. The operator observes the zone display 10 to determine which of the image zones should be scanned, and when the status display 9 indicates that the scanner is ready, accomplishes the scanning of an image zone by positioning the densitometer 12 in the image zone at an appropriate location, then depressing the head to take a measurement. The measurement is input to evaluator 11 which determines whether the data is complete and "plausible", i.e., within normally expected bounds. If the data reading appears to be good, it is then compared in the processor with either the standard data or previously recorded image data stored in memory 5. If the data is found to be within standard, the processor 1 then displays in the display 10 the identity of the next zone to be scanned and uses the status display 9 to indicate that the system is ready to take the next measurement. The operator repeats the procedure as above. Whenever an initial check of the data in evaluator 11 indicates an erroneous reading (e.g., a bad transmission), the flashing red status light signals the operator that another reading of the same image zone should be taken. Whenever an image reading is taken which is found to be out of standard as determined by the data stored in image data memory 5, the system then initiates an ink correction. First of all, the processor 1 refers to image zone memory 2 to determine the identity of the ink keys which are controlling the out-of-standard image zone in the particular form being printed. Having determined which ink keys should be adjusted, the processor 1 then outputs on bus 6 signals to the appropriate ink adjusters to make the necessary adjustment.

The operator does not directly need to be involved in making of the ink adjustments, and only need respond to the display 16 to make measurements in the desired zones as determined by the processor. Such measurements can be made more or less continuously during the course of a run or at predetermined intervals as required by the processor 1. In any event, it is a simple matter for the operator to position the densitometric sensing head in the image zone, then initiate a reading following which the processor itself will accomplish the remaining operations. However, it will also be appreciated that such relatively automatic and foolproof operation is at a substantially reduced cost both in acquisition cost and in equipment complexity such that relatively automatic ink adjustment can be readily made available to a wider range of printing plants.

The procedures and systems above have been implemented in order to simplify ink adjusting to the greatest extent possible while providing the greatest degree of automation consonant with that simplification. A particular feature of the invention is the lack of the need for an elaborate automatic scanning densitometer, and the use in its place of a relatively inexpensive hand-held device. The manually positioned densitometer is free to be positioned anywhere and can be used to make measurements anywhere on the printed sheet of FIG. 1. If desired, the operator can have a marked-up proof to indicate particular locations within each of the image zones A–C which should be measured. Alternatively, the operator is free to select particular portions of the zone, although it is preferable that approximately the same portions be scanned each time.

In the practice of the invention, the ink check strip can typically be omitted, since the densitometer can read directly the image areas themselves. However, if it is desired to utilize an ink check strip, such is also compatible with the practice of the invention.

The optical display 9, 10 which serves as an operator interface to signal the operator as to the status and identity of the next measurement to be taken is offered as an exemplary illustration of such interface means. Other forms such as acoustical prompting can also be utilized as desired.

It will now be apparent that what has been provided is a greatly simplified but highly automated ink adjustment system. The operator during the makeready associates image zones on the form with printing zones on the press, and the automatic system thereupon utilizes that information for making automatic corrections during the course of a run. In addition, the means for guiding the operator through his portion of the control function makes operation of the system highly efficient and largely errorproof.

What is claimed is:

1. A system for controlling ink adjusters in a printing press to print a predetermined form according to the requirements of an image on the form, the printing press having a plurality of ink adjusters for controlling ink feed in ink zones disposed across the press, the system comprising, in combination:

a localized image scanner manually positionable with respect to the printed form for obtaining measurements of image quality at selected positions on the printed form;

processor means for accepting and evaluating said measurements;

means associated with the processor means for segregating the image on the printed form into a plurality of discrete image zones for individualized control;

ink zone memory means cooperating with the processor means for relating the image zones on the printed form to the inking zones in the printing press which control the inking of the image zones;

the processor means further including operator interface means for directing use of the scanner for measurements to be taken in the respective image zones, evaluation means for evaluating the scanner measurements so-taken to determine any out-of-specification image zones, and output means for reading the image zone memories and driving the ink adjusters associated with the out-of-specification image zones to correct said last-mentioned zones; and, the operator interface means being associated with the manually positionable scanner and including display means driven by the processor means for displaying to an operator the busy or ready status of the system for taking a measurement of a predetermined image zone, and means for displaying an identifier for the image zone next to be measured.

2. The system as set forth in claim 1 further including an image data memory having a plurality of data locations for storing measurements taken by the scanner in the respective image zones.

3. The system as set forth in claim 1 wherein the evaluator means further comprises means for comparing the measurement produced by the image scanner with a predetermined standard for that image zone, the evaluator means operating in conjunction with the display means for signalling the operator (a) to take another measurement of the same image zone if the reading is not in a corresponding relationship to the standard or (b) to proceed to measure the next image zone if the measurement is in the predetermined relationship to the standard.

4. The system as set forth in claim 1 wherein the scanner comprises a densitometer having a density measuring head which is manually positionable with respect to the respective image zones on the printed form, and means for bringing the density measuring head into an operative relationship with respect to an image zone on the form and triggering the system to take a measurement.

5. The system as set forth in claim 1 in which the scanner comprises a spectrophotometer for producing measurements relating to image density over a predetermined color spectrum in the image zones.

6. A method of setting ink adjusters on a printing press to print a predetermined form, the press having a plurality of ink adjusters for controlling ink feed in corresponding ink zones disposed across the press, the form carrying an image to be printed by ink supplied across the press and controlled by the adjusters, the method comprising the steps of:

segregating the image on the form into a plurality of image zones, each of the image zones to be printed by ink supplied by respective pluralities of contiguous ink adjusters;

correlating in an image zone memory the image zones on the form with the adjusters on the press which control ink feed to the respective image zones;

manually positioning an image scanner on the printed form to measure and record localized image quality data;

coordinating the positioning of the scanner and the measurement of localized zones in accordance with the image zones stored in the image zone memory to produce an indication of any image zones which are out of specification;

reading the image zone memory for an out-of-specification image zone to determine the identity of an to route an adjustment to the ink adjusters which control ink feed to the out-of-specification image zone for adjustment thereof;

displaying to an operator the busy or ready status of the image scanner for taking a measurement; and displaying to the operator an identifier of the zone next to be measured.

7. The method as set forth in claim 6 further including the step of storing in an image data memory image quality data for the respective image zones as determined by the image scanner.

8. The method as set forth in claim 6 further including the steps of maintaining a stored set of standards for allowable image quality measurements for each of the image zones, comparing the measured image quality data with the standards for the respective image zones and signaling the operator (a) to take another measurement of the same image zone if the measurement is not in a corresponding relationship to the standard or (b) to proceed to measure the next image zone if the measurement is in the predetermined relationship to the standard.

9. The method as set forth in claim 6 wherein the step of measuring image quality data comprises taking local densitometric measurements in the image zone.

10. The method as set forth in claim 6 in which the step of measuring image quality data comprises taking spectrophotometric measurements in the image zone.

11. The method as set forth in claim 6 wherein the step of segregating comprises positioning of a printed form on a control panel segmented in accordance with the ink control zones of the printing press, and utilizing said segmented control panel to define image zones in terms of printing press ink control zones.

12. The method as set forth in claim 6 wherein the step of segregating comprises coupling signals to the image zone memory which define the width and location of the respective image zones in terms of ink control zones on the printing press which correlate to the image zones on the printed form.

* * * * *